United States Patent [19]

Habich et al.

[11] Patent Number: 4,640,502

[45] Date of Patent: Feb. 3, 1987

[54] ENVELOPE HOPPER FOR FEED AND DELIVERY

[75] Inventors: Adolph B. Habich, Austin; Ronald E. Hunt, Georgetown, both of Tex.

[73] Assignee: International Business Machines Corporation, Armonk, N.Y.

[21] Appl. No.: 792,635

[22] Filed: Oct. 28, 1985

Related U.S. Application Data

[63] Continuation of Ser. No. 629,933, Jul. 11, 1984, abandoned, which is a continuation of Ser. No. 335,438, Dec. 29, 1981, abandoned.

[51] Int. Cl.[4] ..... B65H 3/06; B65H 5/02; B65H 1/28

[52] U.S. Cl. ..... 271/4; 271/3.1; 271/6; 271/21; 271/22; 271/119; 271/150; 400/625; 400/629

[58] Field of Search ..... 271/10.21, 31.1, 109, 271/22

[56] References Cited

U.S. PATENT DOCUMENTS

| | | | |
|---|---|---|---|
| 2,366,206 | 1/1945 | Metzner | 400/629 |
| 2,569,692 | 10/1951 | Rockwell | 271/16 |
| 3,200,929 | 8/1965 | Burns et al. | 400/629 |
| 3,372,923 | 3/1968 | Watson | 271/23 |
| 3,776,545 | 12/1973 | White | 271/4 |
| 3,814,000 | 6/1974 | Heisler | 271/3.1 |
| 3,815,896 | 6/1974 | Hoyer | 271/4 |
| 4,084,805 | 4/1978 | Simpson | 271/9 |
| 4,222,557 | 9/1980 | Wu | 271/4 |
| 4,252,307 | 2/1981 | Korte | 271/4 |
| 4,268,021 | 5/1981 | Rutishauser et al. | 400/629 |
| 4,340,314 | 7/1982 | Berger | 400/629 |

FOREIGN PATENT DOCUMENTS

| | | | |
|---|---|---|---|
| 2539200 | 3/1977 | Fed. Rep. of Germany | 271/23 |
| 2715649 | 1/1978 | Fed. Rep. of Germany | 400/629 |
| 0047432 | 4/1979 | Japan | 271/10 |
| 877329 | 9/1961 | United Kingdom | 271/109 |

OTHER PUBLICATIONS

*IBM Technical Disclosure Bulletin*, vol. 11, No. 10, Mar. 1969, p. 1301, J. L. Lyon, "Paper Feed Hopper".

*Primary Examiner*—George E. A. Halvosa
*Assistant Examiner*—James E. Barlow
*Attorney, Agent, or Firm*—Marilyn D. Smith

[57] ABSTRACT

An attachable feed and delivery system for envelopes in a high speed, batch printer (14) environment is described. Included is a hopper (10) having input (30) and output sections (32) separated from each other by a spring loaded bail (34). The transport path to and from the print station includes a picker/separator (90) located adjacent to the input section of the hopper. Fresh envelopes are urged toward the pick area by the spring loaded bail (34). Endless belts (56) passing through the base (50) of the hopper (10) assist in urging printed envelopes into the output area (32).

5 Claims, 9 Drawing Figures

ENVELOPE HOPPER FOR FEED AND DELIVERY

This application is a continuation of U.S. patent application Ser. No. 629,933, now abandoned, filed July 11, 1984, which is a continuation of U.S. patent application Ser. No. 335,438, now abandoned, filed Dec. 29, 1981, and commonly assigned.

BACKGROUND OF THE INVENTION

1. Field

This invention relates to document handling apparatus. Specifically, it relates to apparatus and a method to accomplish in a high speed printing environment the feed of envelopes on edge from and delivery back to a divided hopper.

2. Prior Art

U.S. Pat. No. 4,222,557 to Wu discloses for a printer, a platen driven document handling attachment with rear feed front exit portions for on edge documents in one hopper.

U.S. Pat. No. 3,372,923 to Watson et al. presents a picker roller for documents in a stack on edge. The picker roller has formed in its periphery a knife edge which when placed adjacent the stack projects above the flat by an amount less than the thickness of the thinnest document to be transported. The picker edge engages the endmost card when it is rotated counterclockwise to buckle the bottommost card which upon continued rotation of the picker roller springs back into a nip formed by the picker roller and a feed roller. The picker roller is smooth. The feed roller has a high coefficient of friction with regard to the document to be fed. At this point, the direction of the picker roller is reversed and because of the relation of the coefficience of friction, the document is fed by substantially sliding over the surface of the picker roller.

IBM *Technical Disclosure Bulletin,* Vol. 11, No. 10, March 1969, page 1301 to Lyon teaches having a belt at the base of a hopper for urging documents on edge to a picking area.

SUMMARY OF THE INVENTION

The present invention provides a simple attachment for a printer whereby envelopes placed on edge may be fed from and delivered to a single, divided hopper. Endless belts which pass in part through the floor of the hopper assist in urging the printed envelopes away from the output throat area and into the output area of the hopper. The spring biased hopper separator urges fresh envelopes toward the picking station adjacent the hopper.

BEST MODE FOR CARRYING OUT THE INVENTION

Figure 1:
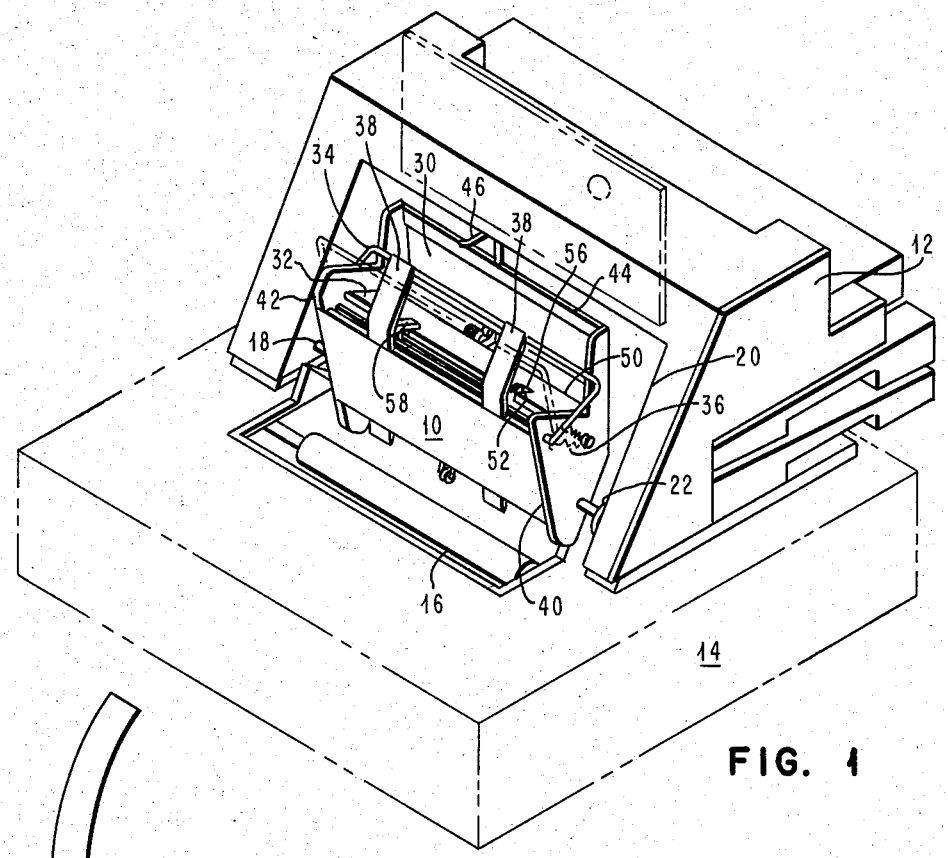
FIG. 1 shows a perspective view of an envelope hopper in accordance with the present invention mounted on the sheet feed device attached to a printer.

Referring now to FIG. 1, the combination hopper 10 of the present invention is illustrated connected to a sheet handling attachment 12 for a high speed printer 14 which may be part of a word procesing or other office automation system. In present systems of this type the need often arises for the preparation of letters and their associated envelopes. The illustrated device contemplates the batch preparation of letters followed by batch printing of the envelopes. That is, after the desired documents have been printed, the combination envelope hopper 10 of the instant invention is attached so as to be operatively connected to and driven by the platen 16 of printer 14.

The connection of hopper 10 to sheet feed device 12 is achieved on one side by spring biased plunger 22 which mates with a hole (not visible) in sheet feed device side wall 20. The opposite end of shaft 18 which extends the width of hopper 10 terminates in an entry to a gear train drivingly connected with platen 16. This connection will be discussed in greater detail with reference to FIG. 2.

As illustrated, hopper 10 includes an input area 0 and output area 32 divided by a bail 34. Bail 34 is biased toward the back of hopper 10 by spring 36. The output area 32 includes transport guides 38. Hopper side walls 40 and 42 connected by back wall 44 complete the external structure of hopper 10. Mounted substantially at the center of the top edge of back wall 44 is envelope top restraint 46.

Hopper floor 50 includes spaced apart aperatures 52 which allow two endless belts 56 to comprise part of floor 50. Attached to the inner surfaces of transport guides 38 in close proximity to endless belts 56 are two leaf springs 58 which assist in envelope delivery back into hopper 10.

Leaf springs 58 will be described in more detail having reference to FIGS. 7 and 8.

Figure 2:
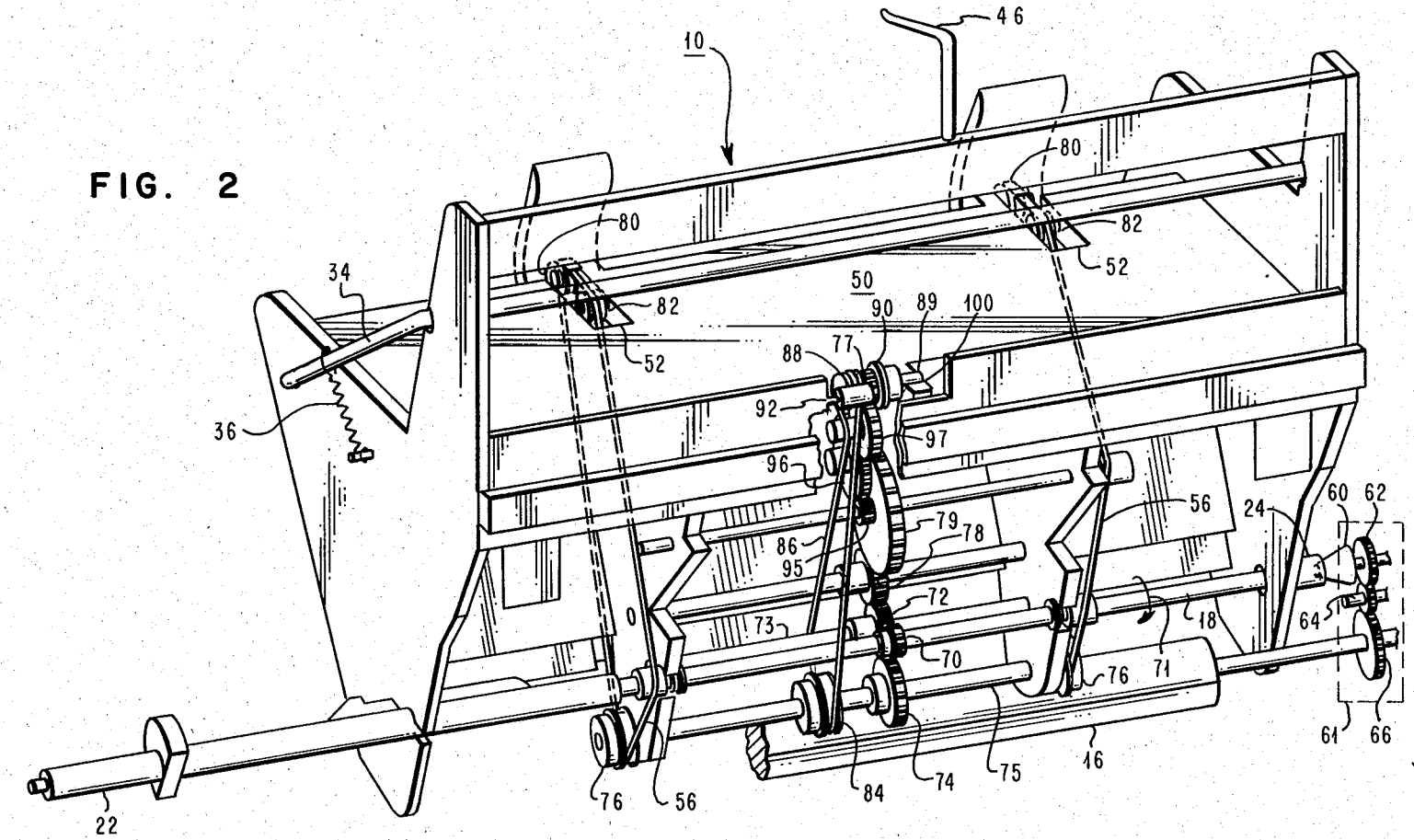
FIG. 2 shows a more detailed rear view of the hopper and the connection between hopper and printer

Refer now to FIG. 2 which is a rear cutaway perspective view of hopper 10 and its driving mechanism.

Shaft 18 is shown with its associated spring loaded plunger 22 for resiliently lodging hopper 10 in one side of sheet handling apparatus 12 of FIG. 1. The opposite end of shaft 18 terminates in a coupling member 24 adapted to engage cone drive roller 60 for rotation therewith.

Cone roller 60 is driven by platen 16 through a gear train 61 comprising gears 62, 64, and 66. Motive power from platen 16, which is driven by appropriate printer controls which form no part of the present invention, is transmitted through gear train 61 to coupling 24 and shaft 18. Cone roller 60 drives shaft 18 clockwise in the direction of arrow 71. Gear 70 is mounted on and for rotation with shaft 18. Gear 70 drivingly engages gear 72 mounted on shaft 73. Gear 72 is thus driven counterclockwise. Gear 72 is in driving engagement with gear 74 mounted on shaft 75 which is thus driven to rotate in the same direction as shaft 18. Shaft 75 has two pulleys 76 mounted thereon. Endless belts 56 are trained over pulleys 76. Belts 56 continue around pulleys 80 and 82 in aperatures 52 in floor 50 of hopper 10. Because the endless belts passing through the aperatures 52 in floor 50 of hopper 10 are identically arranged and driven, the same reference numerals have been given to corresponding parts to simplify the description by requiring a discussion of only one of such identical sets.

Also fixedly attached to shaft 75 is a pulley 84 about which one loop of endless belt 86 is trained. The other loop of endless belt 86 is on pulley 88 mounted on shaft 89. Shaft 89 rests in groove 100 formed in the base 50 of hopper 10. Shaft 89 is held down by the tension in belt 86. Coaxial with pulley 88 on shaft 89 is picker wheel 90. Its backup roller 92 is located adjacent to and on an axis parallel to that of pulley 88.

The driving connection from driven gear 70 to gear 77 on shaft 89 will now be described. Gear 77 is the driving means for shaft 89 and thus picker 90. Gear 72 rotating counterclockwise drives gear 78 in a clockwise direction. Gear 78 drives gear 79 and 95 in a clockwise direction. Gear 95 drives gear 96 in a counterclockwise direction and gear 96 engages gear 97 to drive it in a clockwise direction. Gear 97 engages gear 77 to drive it in a clockwise direction, the original direction of driven gear 70 on shaft 18. The illustrated and described gear train is an exemplary embodiment only. Obviously, those skilled in the art will understand that other gear reduction mechanisms may be designed to drive picker 90 off the platen 16 of the associated printer without departing from the scope of the present invention.

Figure 3:
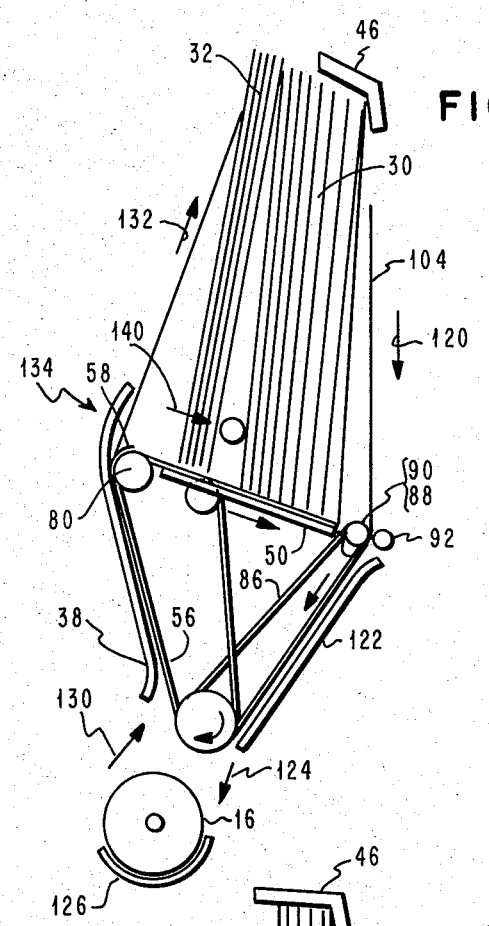
FIG. 3 is a schematic cross-sectional view of hopper 10 and includes the complete envelope transport path.

FIG. 3 is a schematic cross-section of hopper 10. The same structural components as shown in previous figures are identified by the same reference numerals. FIG. 3 is a simplified view of the complete envelope transport path followed by an envelope 104 from the input section 30 of hopper 10 to the hopper output section 32.

Upper envelope restraint 46 aids in keeping envelopes in proper alignment for being picked and fed. Once picked, an envelope 104 moves in the direction of arrow 120 through the throat created by feed roller 88 coaxial with picker roller 90 and the associated backup roller 92. Envelope 104 enters on a path formed by continuously rotating belt 86 and rear guide 122. Rear guide 122 is part of sheet handling apparatus 12 and not visible in FIG. 2. The envelope continues in the direction of arrow 124 between platen 16 and bottom guide member 126. The print station is not shown.

The envelope 104 is then guided in the direction of arrow 130 between continuous belt 56 and front transport guide 38 in the direction of arrow 132 until it reaches output throat area 134 which includes leaf spring 58 for urging the envelope 104, in print order, into section 32 of hopper 10. Output throat area 134 will be described below with reference to FIGS. 7 and 8.

The bottom edge of the envelope comes in contact with endless belt 56 which passes through floor 50 and urges the envelope 104 in the direction of arrow 140 to make room for the next envelope to be fed.

Figure 4:
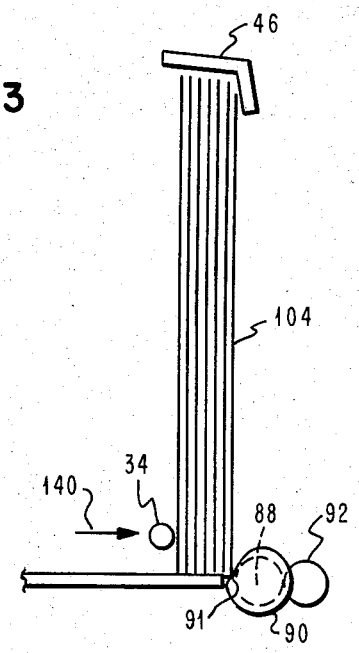
FIGS. 4 through 6 illustrate, step by step, envelope picking, buckling, and entry into the transport path.
Figure 5:
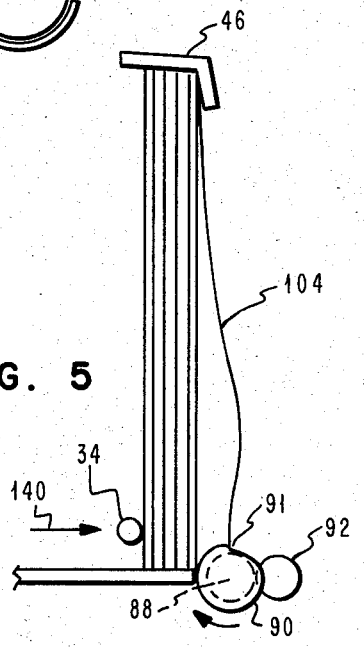
Figure 6:
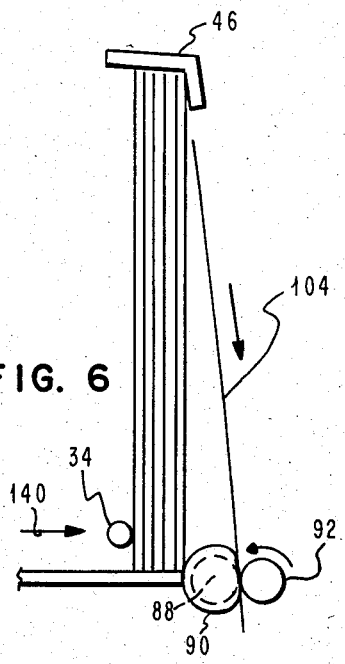

FIGS. 4, 5, and 6 will be discussed together as they illustrate in greater detail the picking action of picker roller 90. A picking lip 91 is provided on picker 90 for engaging the edge of the rearmost envelope 104 in input area 30 of hopper 10. As picker 90 rotates clockwise envelope 104 is engaged by lip 91 and is buckled as shown in FIG. 5. Further clockwise rotation of picker roller 90 causes the envelope 104 to snap over the picker roller 90 and into the nip formed by pulley 88 and backup roller 92.

It will be recalled from FIGS. 2 that picker roller 90 and pulley 88 are coaxially mounted in spaced apart relation on shaft 89. When envelope 104 snaps over picker 90, the envelope flexes to some extent in entering the feed nip since picker 90 is larger in diameter than pulley 88.

Figure 7:
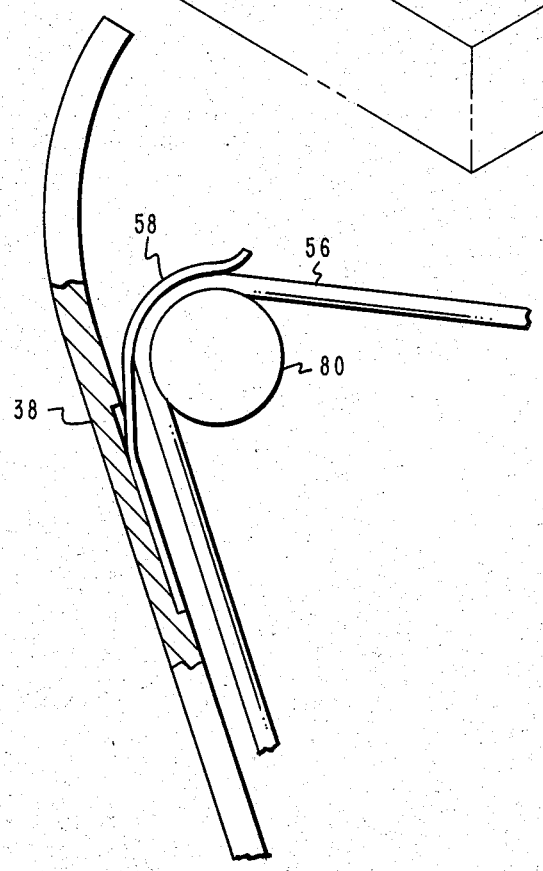
FIGS. 7 and 8 illustrate the output throat area of the transport path.
Figure 8:
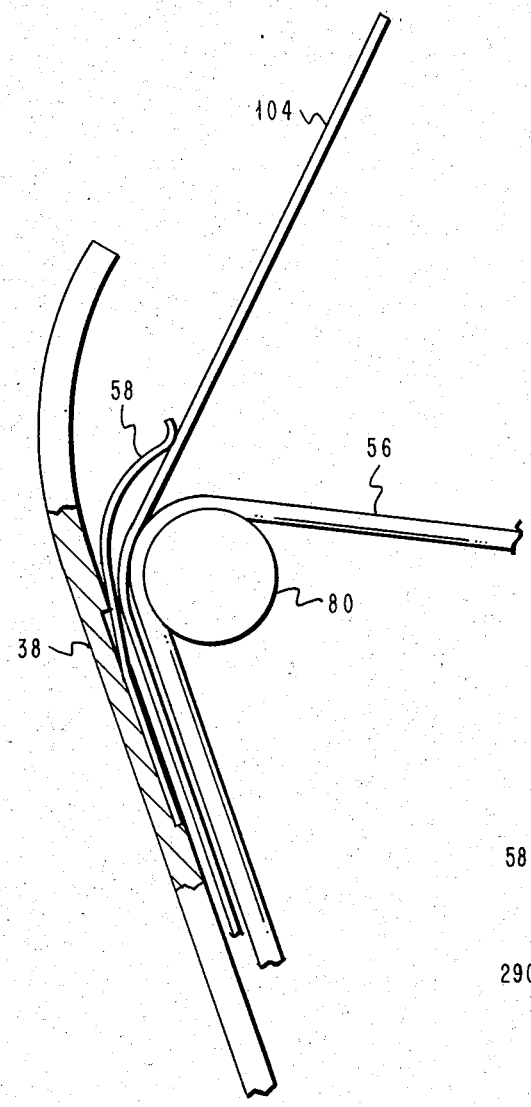

FIGS. 7 and 8 are an enlarged views of the output throat area 134 of FIG. 3. Low force leaf spring 58 is attached to transport guide 38. In its rest position leaf spring 58 conforms generally to the periphery of pulley 80 about which endless belt 56 is trained. When an envelope 104 travelling between front guide 38 and endless belt 56 enters throat area 134 it is gently urged by leaf spring 58 around pulley 80. The strength of leaf spring 58 is such that as envelope 104 continues its upward movement leaf spring 58 moves into the position shown in FIG. 8 at which point the bottom edge of envelope 104 comes under the influence of moving endless belt 56 and is urged into the output area 32 of hopper 10, thereby clearing output throat area 134.

The operation of the present invention is controlled by the printer to which it is attached. The present envelope handling device is intended for batch printing. The gear ratio of the driving connection between platen 16 and picker roller 90 (FIG. 2) is such that the envelope picked during each revolution of picker 90 enters the transport path in timed relation to that preceding. In other words, the space between succeeding envelopes is optimized in relation to the print speed.

A printer for which the present invention is a suitable attachment is provided with a sensor adjacent the platen to monitor the position of an envelope and indicate when the first writing line is reached.

Figure 9:
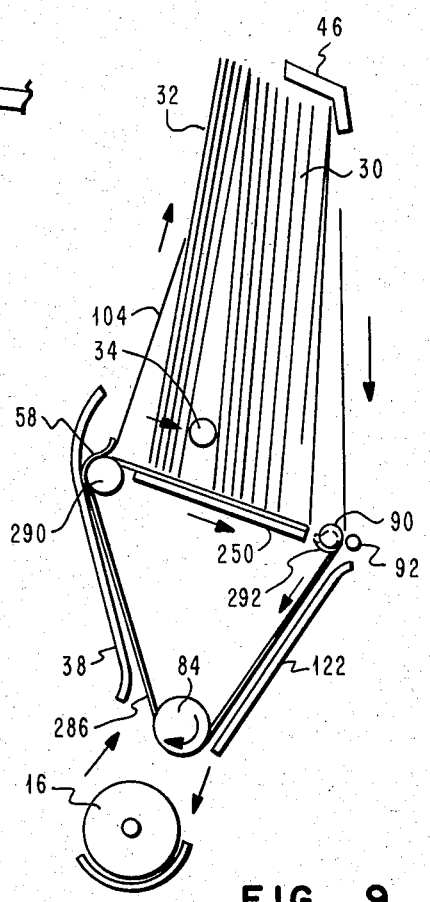
FIG. 9 illustrates an alternative arrangement of the envelope transport path.

FIG. 9 is an alternative embodiment of the transport path of the present invention. Those structural elements which are the same as the first described embodiment are given the same reference numerals. This modification, however, involves two rather than three endless belts (56 and 86, FIG. 2). An aperature 252 in the floor 250 of hopper 200 is analogous to aperatures 52 in FIG. 2. One belt 286 is trained over pulleys 290, 292 and 84. Pulley 84 is driven as previously described.

The operation of this embodiment is simplified because the single belt performs the dual functions of belts 56 and 86 of urging printed envelopes to be fed toward the picker 90 and at the same time urging envelopes in the direction of arrow 140 into the output area of the hopper.

While the invention has been particularly shown and described with reference to a preferred embodiment, it will be understood by those skilled in the art that changes in form and detail may be made without departing from the spirit and scope of the invention.

We claim:

1. Apparatus for feeding documents seriatim from a stack of such documents maintained on edge through a transport path to, around and from a print station located along a rotatably driven platen in a printer comprising:

divided storage means having an input and output hopper located upstream of the platen for holding separately fresh and printed documents;

a picker station adjacent said divided storage having a picker roller, a feed roller and a backup roller, wherein said backup roller and said feed roller form a feed nip, and wherein said picker roller is coaxial to said feed roller, said picker roller located at one side, its axis parallel to the axis of the platen, of the storage means drivingly connected to the platen and having a protruding edge for engaging the bottom edge of a fresh document to be fed and urging it away from the stack and into the transport path, said picker roller having a larger diameter than said feed roller to allow said document to enter the feed nip;

an output throat area having an endless belt, fixed guide means, and resilient means for urging the bottom edge of said printed document to contact relation with said endless moving belt for transporting said document away from said output throat area and into said output hopper;

said transport path being generally triangular in shape and defined by endless belt means continuously moving through said divided storage means, picker station, print station, and output throat;

said continuously moving belt means being provided for simultaneously urging the stack of fresh document toward said picker roller means, urging a picked document around said platen to said output throat, and the printed documents away from the entry area to said printed document storage section of said divided storage means.

2. The apparatus of claim 1 wherein the divided storage means comprises:

a generally planar base, and parallel side walls connected by a wall including an upper restraint means for cooperating with the picker roller for removing a document from the storage means and causing it to enter the transport path.

3. The apparatus of claim 1 wherein the divided storage means is divided by a spring loaded member for providing an additional means for urging fresh documents toward the picker roller means.

4. The apparatus as in claim 1 wherein said continuously moving belt means is operatively connected to said platen.

5. The apparatus as in claim 1 wherein said output throat area further comprises a front transport guide, a leaf spring attached to the inside of said transport guide, a pulley about which an endless belt is trained, said leaf spring having a first rest position wherein said leaf spring conforms to the periphery of said belt around said pulley, and a second position wherein said leaf spring urges the bottom edge of said document in contact relation with said endless moving belt for transporting said document away from said output throat area and into said output hopper.

* * * * *